US007063588B2

(12) United States Patent
Kaneko et al.

(10) Patent No.: US 7,063,588 B2
(45) Date of Patent: Jun. 20, 2006

(54) WOBBLING TOY

(75) Inventors: Yoshinobu Kaneko, Tokyo (JP); Yoshio Suimon, Tokyo (JP)

(73) Assignee: Tomy Company, Ltd., Tokyo (JP)

( * ) Notice: Subject to any disclaimer, the term of this patent is extended or adjusted under 35 U.S.C. 154(b) by 0 days.

(21) Appl. No.: 10/744,069

(22) Filed: Dec. 24, 2003

(65) Prior Publication Data

US 2004/0185746 A1 Sep. 23, 2004

(51) Int. Cl.
*A63H 33/26* (2006.01)
*A63H 3/36* (2006.01)
*A63H 3/46* (2006.01)

(52) U.S. Cl. ..... 446/129; 446/338; 446/384

(58) Field of Classification Search ..... 446/92, 446/129–139, 338, 300, 384, 385, 358, 426; 40/426

See application file for complete search history.

(56) References Cited

U.S. PATENT DOCUMENTS 4,753,623 A * 6/1988 Krut ..... 446/133
5,237,771 A * 8/1993 Watson et al. ..... 43/42.31
5,360,366 A * 11/1994 Lin ..... 446/134
5,462,472 A * 10/1995 Lin ..... 446/135
5,984,757 A * 11/1999 Tsai ..... 446/129
6,604,977 B1 * 8/2003 Saito et al. ..... 446/136
6,719,605 B1 * 4/2004 Ichikawa ..... 446/330
2004/0116036 A1 * 6/2004 Nugent et al. ..... 446/74

FOREIGN PATENT DOCUMENTS

JP 07-072812 3/1995
JP 10137451 * 5/1998

* cited by examiner

*Primary Examiner*—Faye Francis
(74) *Attorney, Agent, or Firm*—Staas & Halsey LLP

(57) ABSTRACT

A wobbling toy having a wobbling part which wobbles centering around a predetermined shaft; a solar battery power source; an integrated circuit for a watch powered by the solar battery; a magnet coil excited by a voltage pulse from the integrated circuit and switching polarity; and a magnetic body provided on the wobbling part, and subjected to an action of an electromagnetic force from the magnet coil.

20 Claims, 4 Drawing Sheets

WOBBLING TOY

BACKGROUND OF THE INVENTION

1. Field of the Invention

The present invention relates a wobbling toy and particularly, to a wobbling toy which is low in price and saves energy.

2. Description of the Related Art

Various wobbling toys have been known, and especially, a wobbling toy in which a dry battery or a button battery is used as an electric source, and a motor is used as a power source has been well known. A wobbling toy in which a shaft of a wobbling part is simply inserted into a shaft hole to be supported, or both end surfaces of the shaft are lightly held to prevent a movement of the shaft in an axis direction thereof is generally known.

However, in the case of using a dry battery or a button battery as a power source, a problem occurs when there is a need for battery replacement, which is troublesome, and expensive. In a wobbling toy in which a motor is used as a power source, there is a problem that the motor costs a lot. Moreover, in a wobbling toy in which the shaft of the wobbling part is simply inserted into the shaft hole to be supported, or both end surfaces of the shaft are lightly held, friction on a bearing is huge while wobbling, and a measurable amount of power consumption is required.

SUMMARY OF THE INVENTION

The present invention has been developed in view of the above problems, and an object of the present invention is to provide a wobbling toy which is low in price and is actuated with low electricity.

The wobbling toy having a wobbling part which wobbles centering around a predetermined shaft can include: (1) a solar battery as a power source; (2) an integrated circuit for a watch which is actuated by the solar battery; (3) a magnet coil which is excited by a voltage pulse from the integrated circuit, and switches a polarity; and (4) an electromagnet which is provided on the wobbling part, and is subjected to an action of an electromagnetic force from the magnet coil.

According to the wobbling toy, since the solar battery is used, there is no battery to be replaced, thereby reducing the cost for maintenance thereof. Moreover, the integrated circuit (IC) for a watch which is low in price in comparison with a normal integrated circuit (IC) is used, so the cost can be reduced.

In the wobbling toy at least both end parts of the predetermined shaft can be formed in a square shape, and a ridgeline part formed by two adjacent surfaces of a periphery of each of the both end parts is supported by a spring from below in a point contact state.

According to the wobbling toy, since the wobbling is performed centering around the ridgeline parts of the both end parts of the shaft, the friction is low while wobbling and also, it becomes possible to make the toy wobble with low electricity.

In the wobbling toy at least the both end parts of the predetermined shaft can be formed in a square shape, the wobbling toy can include first springs which point-contacts with a sharp point formed by the two adjacent surfaces of the periphery and second springs which contact an end surface of the predetermined shaft of each of the both end parts, and a movement in an axis direction of the shaft is suppressed by each of the second springs.

According to the wobbling toy, since the movement of the shaft in the axis direction thereof is suppressed by the springs, each of which point-contacts with the sharp point of each of the both ends of the shaft, the friction is low while wobbling and also, it becomes possible to make the toy wobble with low electricity.

DETAILED DESCRIPTION OF THE EMBODIMENTS

Figure 1:
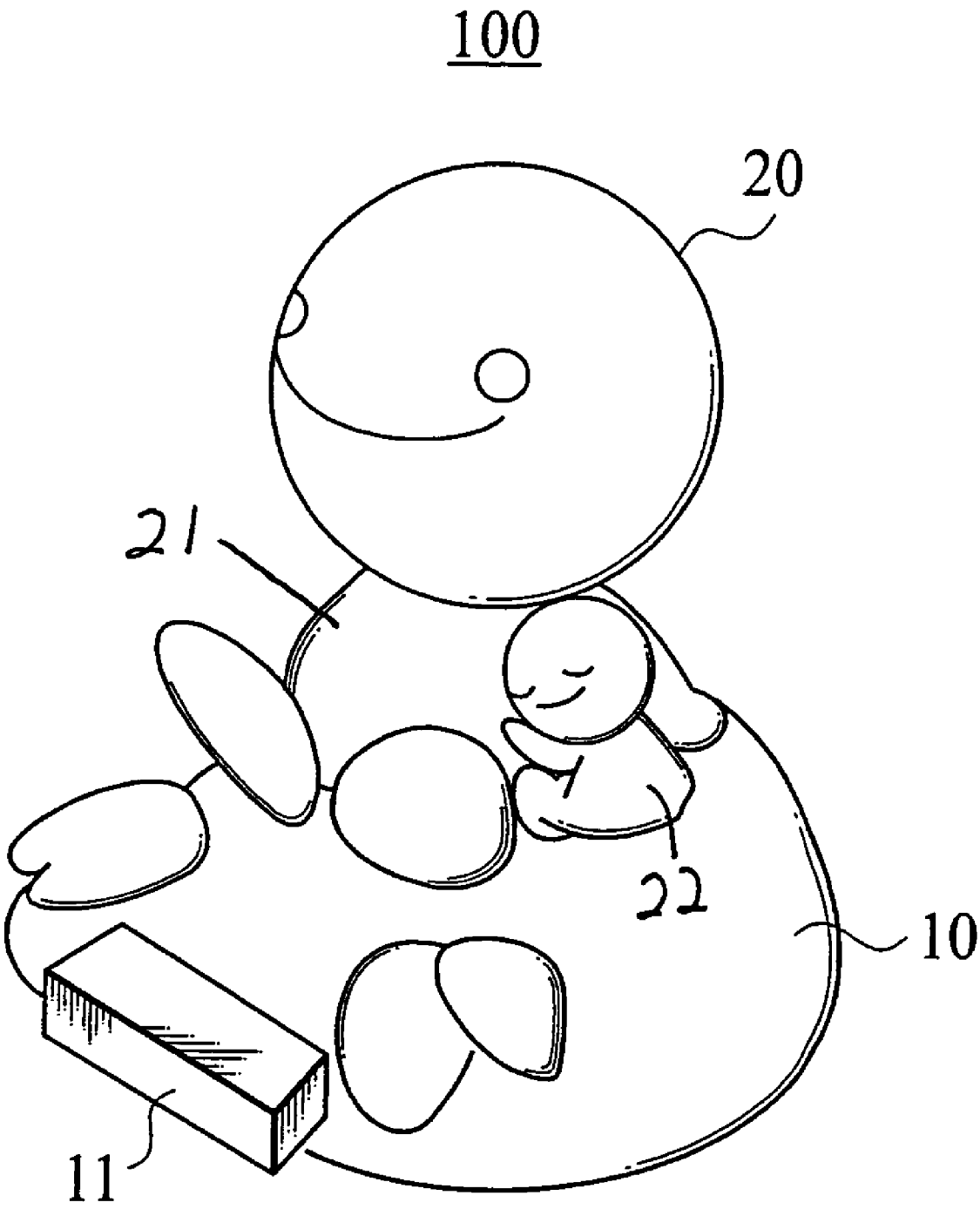
FIG. 1 is a perspective view showing an embodiment of a wobbling toy according to the present invention.

A wobbling toy 100 includes a base 10 and a doll body 20 as shown in FIG. 1.

The base 10 is formed in a bowl shape representing a hill or a field. A stage 11 is formed on a front side of the base 10, and a solar battery is mounted in a footboard part of the stage 11. A power switch which is not shown is provided on a back side of the base 10. This power switch 10 is not necessarily provided.

The doll body 20 includes an adult doll 21 and a child doll 22. The adult doll 21 is shaped in a sitting posture on the base 10, and the child doll 22 is formed in a state of leaning over on the adult doll 21. The adult doll 21 is configured such that a head part 21*b* wobbles from side to side to a body part 21*a*.

Figure 2:
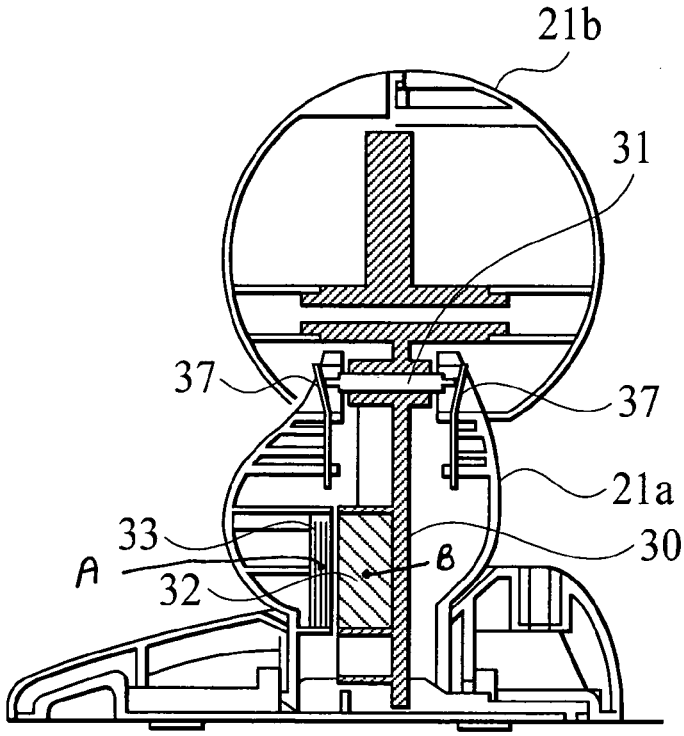
FIG. 2 is a cross sectional view of the wobbling toy seen from a side.
Figure 3:
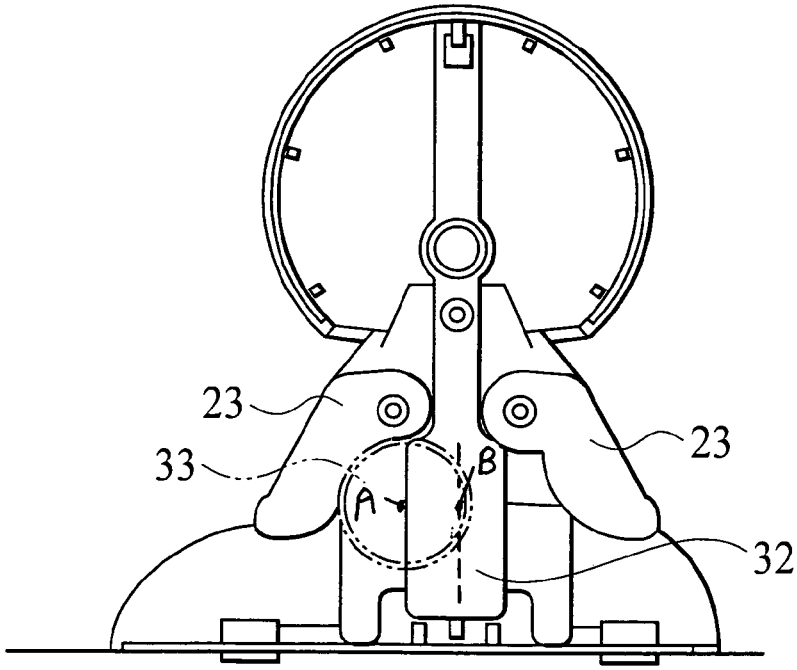
FIG. 3 is a cross sectional view of the wobbling toy seen from a front side.

As shown in FIGS. 2 and 3, the wobbling toy 100 is provided with a pendulum 30 inside thereof. The pendulum 30 can wobble from side to side centering around a shaft 31 supported by the body part 21*a*. The pendulum 30 is fixed on the head part 21*b* at an upper side portion, and is provided with a permanent magnet 32 at a lower portion. The permanent magnet 32 is formed in a cylindrical shape, and is mounted to the pendulum 30 to make one of the north pole and south pole face the front.

The wobbling toy 100 is also provided with a magnet coil 33 inside thereof, a central line of which extends in a direction perpendicular to a wobbling surface of the pendulum 30. The center "A" of the magnet coil 33 is positioned on a left side in FIG. 3 with respect to a center axis "B" of the permanent magnet 32 provided on the lower portion of the pendulum 30 at the back side of a belly of the doll 21.

Right and left arms of 23, 23 of the doll 21 extend into the body part 21*a* to be fixed.

Figure 4:
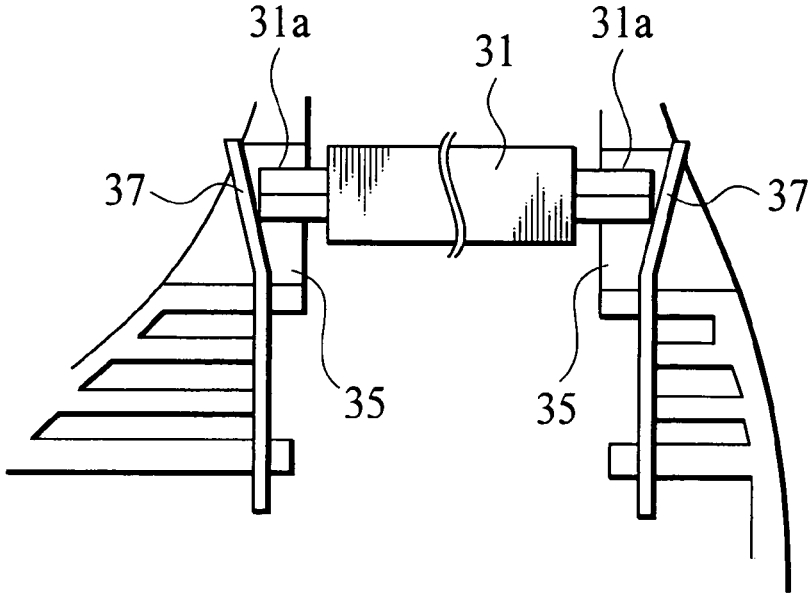
FIG. 4 is a perspective view of a support structure of a shaft.
Figure 5:
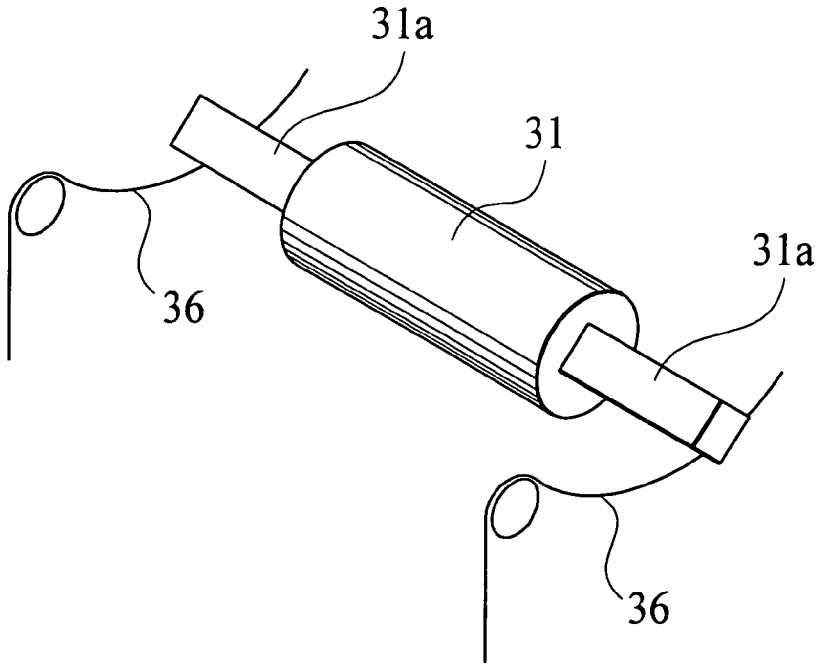
FIG. 5 is a perspective view showing a structure for suppressing movement in an axis direction of the shaft.

As shown in FIGS. 4 and 5, both end parts 31*a*, 31*a* of the shaft 31 are formed in a square bar shape, each of which is inserted into a round hole 35 formed in the body part 21*a*. A torsion coil spring 36 is provided near each of the round holes 35, 35 in the body part 21*a*. One end of each of the torsion coil springs 36, 36 is in point-contact with a corner (a ridgeline formed by two adjacent surfaces of a periphery of the shaft) of each end portion 31*a*, 31*a* of the shaft 31 from below, respectively, to support the shaft 31.

As shown in FIGS. 2 and 4, the body part 21*a* is provided with a leaf spring 37 near each end of the shaft 31. Both of the leaf springs 37 are in point-contact with both end corners (a sharp point formed with the two adjacent surfaces of a periphery of the shaft and an end surface of the shaft) of the shaft 31 from below, respectively. The leaf springs 37 function to suppress movement of the shaft 31 in an axis direction.

Figure 6:
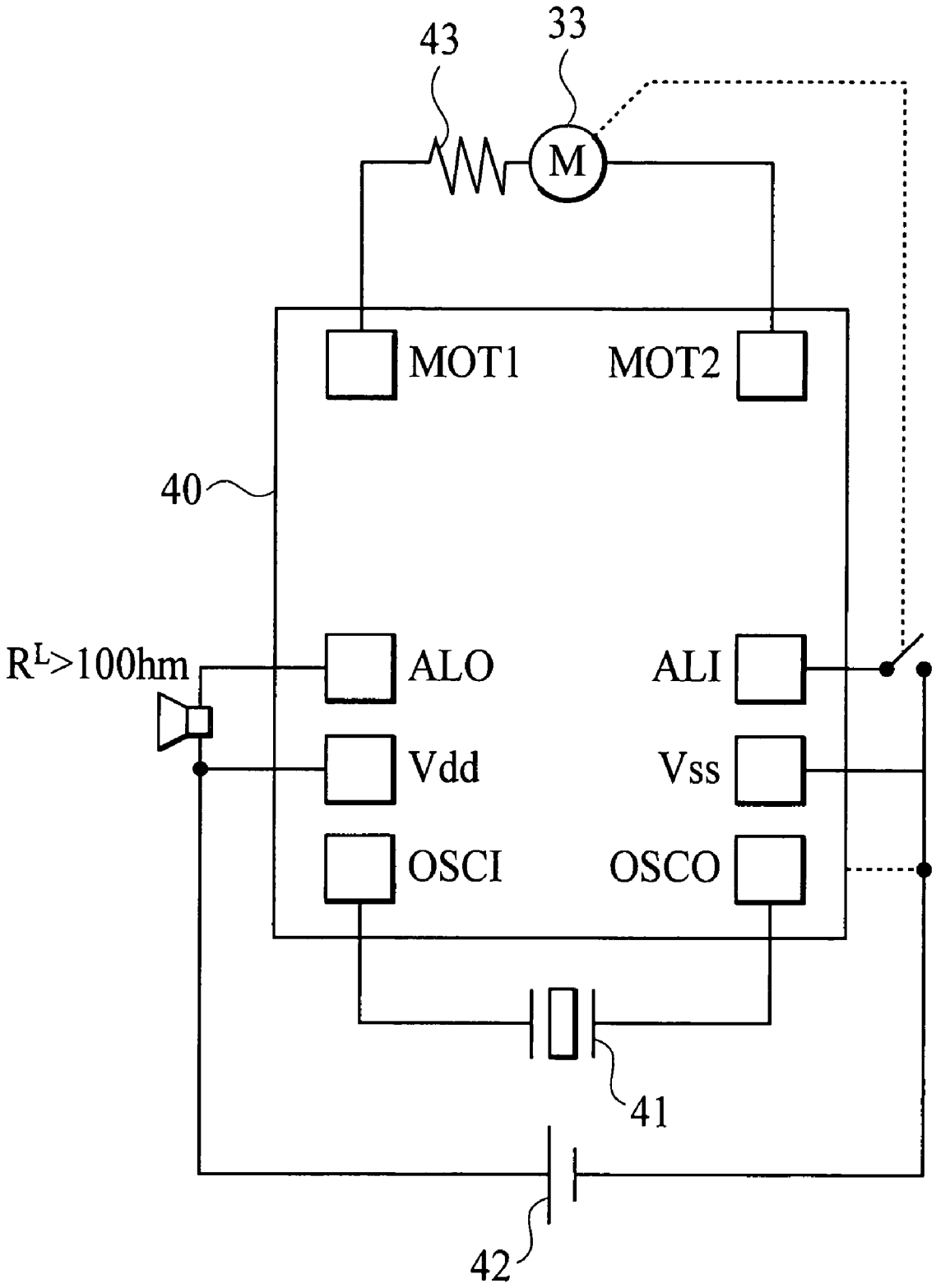
FIG. 6 is an integrated circuit diagram.

The wobbling toy 100 is provided internally with an integrated circuit (IC) for a watch 40 shown in FIG. 6. A solar battery 42 is used as a power source for the IC for a watch 40, and a crystal oscillator 41 is activated by electricity stored in the solar battery 42. The magnet coil 33 connected to the IC for a watch 40 is excited by a voltage pulse from the IC for a watch 40. In this case, the voltage pulse is applied from the IC for a watch 40 to both ends of the magnet coil 33 alternately. Thus, a portion of the magnet coil 33 which faces the permanent magnet 32 changes the polarity from north to south pole or vice versa. By changing the polarity, the pendulum 30 is wobbled from side to side.

The magnet coil 33 is provided with a resistance 43 in series. The reason to provide the resistance 43 is as follows. The magnetic coil 33 has a low resistance when current starts to flow, therefore, electricity is consumed immediately for a while after the solar battery 42 has started to store electricity. It may cause the pendulum 30 not to wobble. For preventing this problem, the resistance 43 is provided.

When the wobbling toy 100 is put in the presence of a bright light, the solar battery 42 stores electricity. Voltage pulses are output from the IC for a watch 40 by the electric power stored in the solar battery 42 to excite the magnet coil 33. In this case, the magnet coil 33 changes the polarity, enabling the pendulum 30 thus the head part 2*b* to wobble from side to side by the electromagnetic power.

The embodiment of the present invention has been explained above, however, it is understood that the present invention is not limited to the embodiment and various changes may be resorted to without departing from the scope of the invention.

A representative effect of the present invention is as follows. The wobbling toy having a wobbling part which wobbles centering around a predetermined shaft can include (1) a solar battery as a power source, (2) an integrated circuit for a watch which is actuated by the solar battery, (3)a magnet coil which is excited by a voltage pulse from the internal circuit, and switches a polarity, and (4) an electromagnet provided on the wobbling part, and is subjected to an action of an electromagnetic force from the magnet coil, so that the wobbling toy which is low in price and saves energy can be realized.

What is claimed is:

1. A wobbling toy having a wobbling part which wobbles around a shaft, comprising:

a solar battery as a power source;

a circuit which is actuated by the solar battery;

a magnet coil which is excited by a voltage pulse from the circuit, and switches polarity; and a magnetic body which is provided on the wobbling part, and is subjected to an action an electromagnetic force from the magnet coil, wherein the shaft has two end parts each having a square cross-section, and a-pointed edges formed by two adjacent surfaces of peripheral four plane surfaces forming the square cross-section end parts, each edge being supported from below by first springs, respectively.

2. The wobbling toy as claimed in claim 1, wherein the magnetic body is a permanent magnet.

3. The wobbling toy as claimed in claim 2, wherein the permanent magnet is mounted to the wobbling part to make one of a north pole and a south pole face a front of the toy.

4. The wobbling toy as claimed in claim 1, further comprising second springs contacting an end surface of each of the both square cross-section end parts, and a movement in an axis direction of the shaft is suppressed by each of the second springs.

5. The wobbling toy as claimed in claim 1, wherein the magnetic body is formed in a cylindrical shape.

6. The wobbling toy as claimed in claim 1, wherein a central line of the magnet coil extends in a direction perpendicular to a wobbling surface of the wobbling part.

7. The wobbling toy as claimed in claim 1, wherein the magnetic body is provided on a lower portion of the wobbling part.

8. A wobbling toy having a wobbling part which wobbles around a shaft comprising:

a solar battery as a power source;

a circuit which is actuated by the solar battery;

a magnet coil which is excited by a voltage pulse from the circuit, and switches polarity; and a magnetic body which is provided on the wobbling part, and is subjected to an electromagnetic force from the magnet coil, wherein the shaft has two end parts each having a square cross-section, the wobbling toy includes first springs, each of which contacts a pointed edge formed by two adjacent surfaces of peripheral four plane surfaces forming square cross-section end parts, second springs contacting an end surface of each of the both square cross-section end parts, and a movement in an axis direction of the shaft is suppressed by each of the second springs.

9. The wobbling toy as claimed in claim 8, wherein the magnetic body is formed in a cylindrical shape.

10. The wobbling toy as claimed in claim 8, wherein a central line of the magnet coil extends in a direction perpendicular to a wobbling surface of the wobbling part.

11. The wobbling toy as claimed in claim 8, wherein the magnetic body is provided on a lower portion of the wobbling part.

12. The wobbly toy as claimed in claim 8, wherein the magnetic body is a permanent magnet.

13. The wobbly toy as recited in claim 12, wherein the permanent magnet is mounted to the wobbly part to make one of a north pole and a south pole face a front of the toy.

14. A wobbling toy comprising:

a swinging part; and a pendulum which is fixed to the swinging part and is able to wobble around a shaft as a center, wherein the shaft has two end parts, and wherein the swinging part wobbles when the pendulum moves, and at least both end parts of the shaft have a square cross-section, and pointed edge formed by two adjacent surfaces of peripheral four planar surfaces forming the square cross-section parts, each edge being in contact from below for support by first springs, respectively, and second springs contact an end surface of each of the end parts of the shaft, wherein a movement in an axis direction of the shaft is suppressed by each of the second springs.

15. The wobbling toy as claimed in claim 14, wherein the swinging part comprises a head part of a doll, and the both end parts of the shaft are received by a body part of the doll.

16. A wobbling toy comprising a wobbling part which wobbles around a shaft:

a solar battery as a power source;

a circuit which is actuated by the solar battery;

a magnet coil which is excited by a voltage pulse from the circuit, and switches polarity; and a magnetic body which is provided on the wobbling part, and is subjected to an action an electromagnetic force from the magnet coil, wherein the shaft has two end parts each having a pointed edge supported from below a spring, respectively.

17. The wobbling toy as claimed in claim 16, wherein the magnetic body is a permanent magnet.

18. The wobbling toy as claimed in claim 17, wherein the permanent magnet is mounted to the wobbling part to make one of a north pole and a south pole face a front of the toy.

19. A wobbling toy comprising:

a swinging part; and a pendulum which is fixed to the swinging part and is able to wobble around a shaft as a center, wherein the shaft has two end parts, and wherein the swinging part wobbles when the pendulum moves, and at least both end parts of the shaft have a pointed edge in contact from below for support by a first spring, respectively, and second springs contact an end surface of each of the end parts of the shaft, wherein a movement in an axis direction of the shaft is suppressed by each of the second springs.

20. The wobbling toy as claimed in claim 19, wherein the magnetic body is a permanent magnet.

* * * * *